United States Patent [19]

Coffey

[11] 4,109,351

[45] Aug. 29, 1978

[54] SEALING CLAMP FOR MILK CARTONS AND SIMILAR CONTAINERS

[76] Inventor: Darius A. Coffey, 13613 Occidental Ave. South, Seattle, Wash. 98168

[21] Appl. No.: 807,258

[22] Filed: Jun. 16, 1977

[51] Int. Cl.[2] ..... A44B 21/00

[52] U.S. Cl. ..... 24/258; 24/30.5 R; 229/47

[58] Field of Search ..... 24/258, 248 B, 248 E, 24/250 R, 30.5 R; 229/47, 65

[56] References Cited

U.S. PATENT DOCUMENTS

| | | | |
|---|---|---|---|
| 517,278 | 3/1894 | Hoyt | 24/250 |
| 1,027,603 | 5/1912 | Hildreth | 24/258 |
| 1,046,282 | 12/1912 | Dusetzina | 24/258 |
| 1,336,129 | 4/1920 | Cass et al. | 24/258 |
| 3,112,542 | 12/1963 | Brunson | 24/30.5 R |
| 3,693,864 | 9/1972 | Wilkins | 24/30.5 R |

*Primary Examiner*—Kenneth J. Dorner
*Attorney, Agent, or Firm*—Chernoff & Vilhauer

[57] ABSTRACT

A clamp for resealing an opened milk carton includes a U-shaped clamp arm having parallel legs, with high friction surfaces on their inner faces, configured for fitting over and enclosing the top flap of the carton. A squeezing arm extends from joinder with the extremity of one of the legs back around the other leg and terminates in a boss which is located longitudinally intermediate the ends of the clamp arm. Journaled in the boss is a lever which is configured for squeezing the legs of the clamp arm together upon rotation of a handle associated with the lever. A lock positioned on the handle engages the clamp arm to secure the clamp in its closed position thereby preventing inadvertent dislodgement or opening of the clamp.

3 Claims, 7 Drawing Figures

FIG. 1
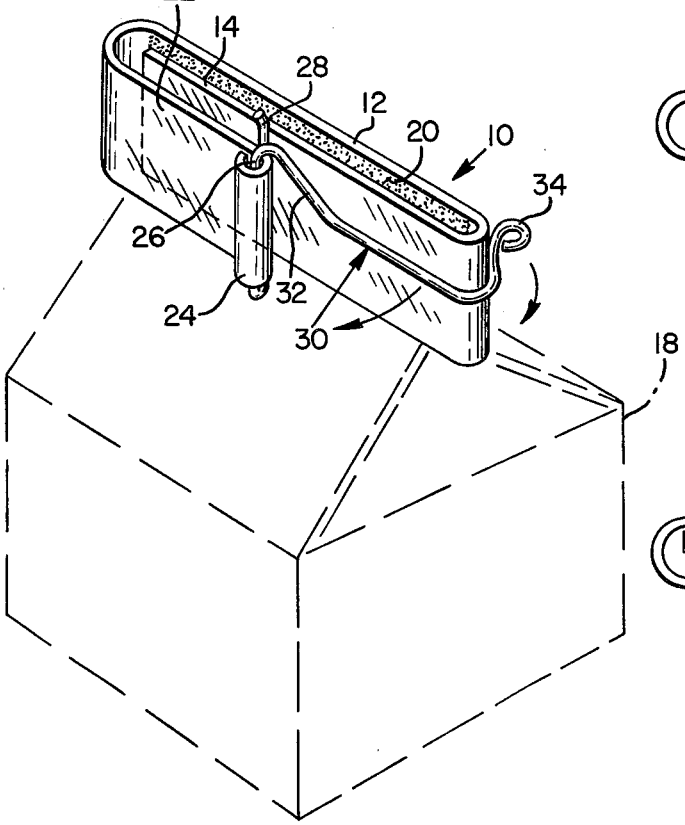
FIG. 2
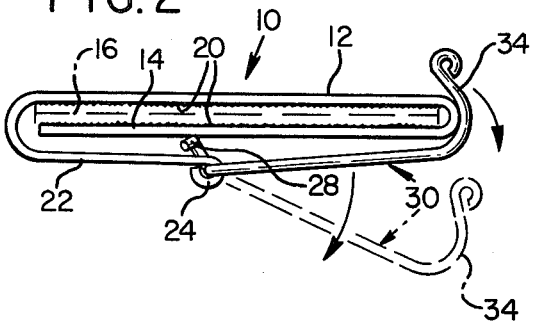
FIG. 3
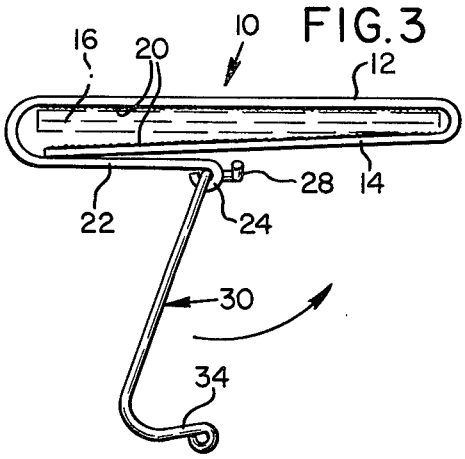
FIG. 4
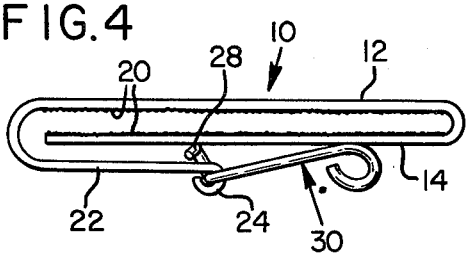
FIG. 5
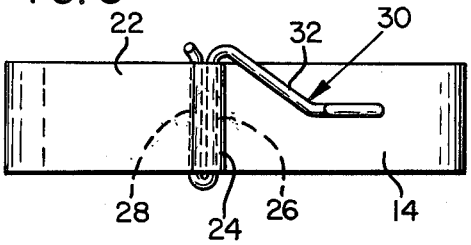
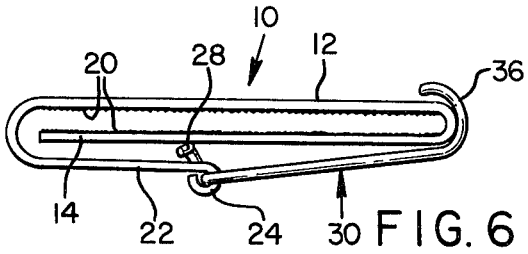
FIG. 6
FIG. 7
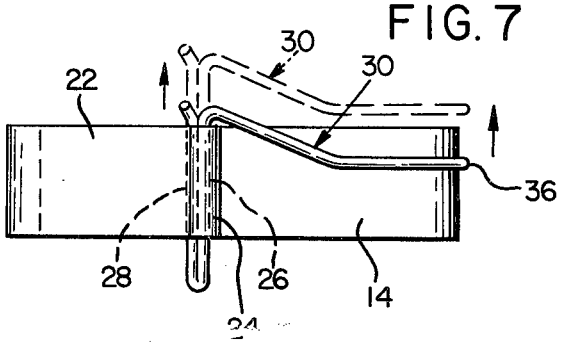

SEALING CLAMP FOR MILK CARTONS AND SIMILAR CONTAINERS

BACKGROUND OF THE INVENTION

This invention relates to a clamp for resealing opened milk cartons, and in particular to such a clamp which is positively secured in its closed position.

Once the top flap of a milk carton has been opened, it is not readily re-sealable in the event that the contents of the carton are not entirely consumed. However, if the carton is not tightly sealed after it is opened, pests such as bugs and flys may enter it and contaminate the remaining contents. Likewise other contaminants such as odors, germs or bacteria may enter the carton making its contents unuseable. Finally the contents of the carton will spill if it is accidentally tipped or if it is transported after opening. The above problems are particularly apparent with the smaller single serving containers which are not generally used for in-home use, but arise in all sizes of cartons.

Heretofore clips of the type shown in Goldman, U.S. Pat. No. 3,458,110 and Harris, U.S. Pat. No. 3,381,883 have been used to alleviate this problem. However clips of this class rely on a spring closure rather than providing a positive two position clamp. Therefore, they do not effectively seal the carton and are subject to dislodgement during handling.

While two position clamps having mechanical elements similar to the present invention are known in the prior art, as typified for example by Hill U.S. Pat. No. 610,967, Pilkington, U.S. Pat. No. 884,040 and Cass et al U.S. Pat. No. 1,336,129, they are not suitable for the subject application and are not adaptable thereto.

SUMMARY OF THE INVENTION

In order to overcome the aforementioned disadvantages of the prior art devices of this class, the principal invention provides a clamp comprising a U-shaped clamp arm, configured for fitting over the top flap of a carton, having parallel legs with high friction surfaces on their inner faces adapted to tightly seal the top flap upon deflection of one of the legs inwardly towards the other leg. A squeezing arm, which is joined to one of the legs, is reversely bent back around the other leg and terminates in a cylindrical boss. Rotatably journaled in the boss is a pivot rod which is operably connected to a squeezing rod in a manner allowing the squeezing rod to be rotated to a closed position between the boss and the adjacent leg to deflect this leg inwardly towards the other leg thereby clamping the carton top flap therebetween. The squeezing rod is actuated by a handle which is connected to the pivot rod and which has an integral lock adapted for engaging the clamp arm in a manner for locking the device securely in its closed position.

It is a principal object of the present invention to provide a clamp of the aforementioned class which securely clamps and reseals the top flap of a milk carton.

It is a further object of the present invention to provide a clamp of the aforementioned class which has a lock to further secure it in its closed position.

It is a still further object of the present invention to provide a clamp of the aformentioned class which is of simplified construction for inexpensive manufacture, long life and ease of operation.

It is a further object of the present invention to provide a clamp of the aforesaid class which can be installed and closed with one hand.

It is a still further object of the present invention to provide a clamp of the aforesaid class which is not easily dislodged once it is installed.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view showing a preferred embodiment of the clamp of the present invention as installed on a milk carton which is shown in phantom line.

FIG. 2 is a top view of the clamp of FIG. 1, in its closed position.

FIG. 3 is a top view, similar to FIG. 2, of the clamp in its open position.

FIG. 4 is a top view of another embodiment of the clamp.

FIG. 5 is the side elevational view of the clamp shown in FIG. 4.

FIG. 6 is a top view of another embodiment of the invention.

FIG. 7 is a side view of the clamp shown in FIG. 6.

DETAILED DESCRIPTION OF THE INVENTION

Referring to FIGS. 1, 2 and 3 of the drawings, the clamp of the present invention comprises a U-shaped clamp arm 10 having spaced apart parallel planar legs 12 and 14. The legs are co-extensive and are dimensioned to slideably fit over and cover the top flap 16 of a milk carton 18 or similar container. The inside faces of the legs are roughened have high friction surfaces 20 for obtaining a better grip on the top flap.

Attached to the extremity of leg 12 is a squeezing arm 22, which has the same height and thickness as leg 12. The squeezing arm is reversely bent around the extremity of leg 14 and extends substantially parallel thereto at a spaced distance therefrom. The squeezing arm terminates near the longitudinal center of the clamp arm in lever retaining means, such as hollow cylindrical boss 24. In the embodiment illustrated legs 12 and 14, squeezing arm 22 and boss 24 are formed by appropriate bending of a length of flat bar stock.

Associated with the lever retaining means is lever means, which in the embodiment illustrated is comprised of a cylindrical rod configured for rotatably fitting within boss 24. The lever means includes a pivot rod 26 which is journaled in the boss and which has a squeezing rod 28 extending upwardly from attachment to its lower end to a position between the boss and leg 14. Attached to the upper end of pivot rod 26, and extending substantially normally thereto, is a gripping rod 30 which serves as a handle for manipulation of the lever means. Accordingly means are provided at each end of the pivot rod for limiting its longitudinal displacement in boss 24. The gripping rod has an offset portion 32 which locates the terminal portion of the gripping rod laterally medially of the clamping arm, to facilitate locking means which will be more fully explained later.

The elements of the lever means are arranged such that when the gripping rod is positioned substantially normal to clamp arm 10, squeezing rod 28 is rotated to an open position, FIG. 3, away from the space between boss 24 and leg 14. Accordingly legs 12 and 14 are placed in their relaxed positions allowing the clamp to be placed over or removed from top flap 16. Conversely, when the gripping rod is moved to a position substantially parallel to the clamp arm, the squeezing rod is rotated to a closed position, FIG. 2, between the boss and leg 14. In this position the squeezing arm engages leg 14 and deflects it inwardly toward leg 12 thereby clamping the top flap of the carton and sealing it shut.

The squeezing arm terminates in locking means for locking the squeezing arm in its closed position to prevent accidental or inadvertent opening of the clamp. In the embodiment of the invention shown in FIGS. 1, 2 and 3, the locking means includes a hooked terminal portion 34 configured to snap over the U-shaped end of clamp arm 10 when the gripping rod is rotated to place the lever rod in its closed position. To reopen the clamp, hook 34 must be disengaged from the clamp arm by snapping it thereover.

Another embodiment of the locking means is illustrated in FIGS. 6 and 7. In this embodiment the gripping rod terminates in a U-shaped lock element 36 which is arranged to tightly conform to the U-shaped end of clamp arm 10. Lock 36 is configured in such a manner that it cannot be snapped into or out of place over the clamp arm. Therefore to accommodate locking or unlocking of the clamp, the pivot and squeezing rods extend downwardly beyond the extent of boss 24. Accordingly the gripping rod can be raised to the position shown in the phantom lines of FIG. 7 then moved inwardly or outwardly to rotate the squeezing rod respectively to its open or closed position. To lock the device in its closed position the gripping arm is lowered to the position shown in solid lines in FIG. 7, to place hook 36 over the clamp arm. This lock is even more secure than that of the prior embodiment, but is somewhat more cumbersome to manipulate.

While the locking means of the type described serve to prevent reopening of the clamp, they are not necessary to its operation. It will be noted that when the squeezing rod is in its closed position it is rotated past center against leg 14, thereby requiring a positive opening force to be applied to the gripping rod to initiate opening of the clamp. An embodiment of the clamp not utilizing locking means is shown in FIGS. 4 and 5.

It will be appreciated that when in its locked position each embodiment of the clamp securely closes and seals the top flap of the carton for preventing spillage of its contents irrespective of the orientation of the carton. While the locking means do further secure the device on the carton its basic design augmented by friction surfaces 20 located on the inner faces of the clamp arm legs serves to prevent accidental dislodgement of the clamp from the carton.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A clamp for resealing the top flap of milk cartons or similar containers comprising:

(a) a U-shaped clamp arm having spaced apart parallel legs configured to slideably enclose said top flap;

(b) a squeezing arm attached to the extremity of one of said legs, said squeezing arm being reversely bent around the extremity of the other of said legs extending substantially parallel thereto, and terminating intermediate the ends of the other of said legs;

(c) lever retaining means located on the terminal extremity of said squeezing arm, said lever retaining means including a hollow cylindrical boss;

(d) lever means associated with said lever retaining means movable in a manner for engaging said other of said legs intermediate its ends deflecting it towards said one of said legs;

(e) said lever means including (1) a pivot rod rotatably journaled within said boss, (2) said pivot rod having means to limit its longitudinal travel in said boss, (3) a squeezing rod connected to one end of said pivot rod, (4) said squeezing rod being configured in a manner to extend between said boss and said other of said legs substantially parallel thereto, when said lever means is in its closed position; and (f) handle means interconnected to said lever means for moving said lever means between a closed position, wherein said lever means is in engagement with said other of said legs, and an open position, wherein said lever means is disengaged from said other of said legs.

2. The clamp of claim 1 wherein the handle means includes a gripping rod integrally connected to said pivot rod, said gripping rod comprising;

(a) an offset portion arranged to position the gripping rod laterally medially of said clamp arm, and (b) a hooked terminal portion adapted to releasably engage the end of the clamp arm when said lever means is in its closed position in a manner for locking it in said position.

3. The clamp of claim 1 wherein the lever retaining means includes a hollow cylindrical boss and the lever means comprises;

(a) a pivot rod rotatably journaled within said boss, (b) a squeezing rod connected to one end of said pivot rod, (c) said squeezing rod being configured in a manner to extend between said boss and said other of said legs substantially parallel thereto, when said lever means is in its closed position, (d) a gripping rod connected to said pivot rod, (e) said pivot rod configured for lateral movement in said boss between a raised position wherein said gripping rod is located above said clamp arm and a lowered position wherein said gripping rod is located laterally medially of said clamp arm, and (f) a U-shaped lock connected to the extremity of the gripping arm in a manner to fit over the clamp arm when the lever means is in its closed position, thereby locking the clamp in this position.

* * * * *